United States Patent [19]

Klein

[11] 4,027,520

[45] June 7, 1977

[54] BLIND RIVETER WITH AUTOMATIC RIVET FEED

[75] Inventor: Günter Klein, Walldorf, Hessen, Germany

[73] Assignee: GESIPA Blindniettechnik Gesellschaft mit beschrankter Haftung, Frankfurt, Germany

[22] Filed: Sept. 2, 1975

[21] Appl. No.: 609,536

[30] Foreign Application Priority Data

Aug. 30, 1974 Germany ..... 2441707
Aug. 30, 1974 Germany ..... 7429354[U]

[52] U.S. Cl. ..... 72/391; 72/453.17
[51] Int. Cl.[2] ..... B21J 15/34
[58] Field of Search ..... 72/391, 114, 424, 453, 72/453.17

[56] References Cited

UNITED STATES PATENTS

| | | | |
|---|---|---|---|
| 2,435,652 | 2/1948 | Koehler | 72/424 |
| 3,367,166 | 2/1968 | Newton | 72/391 |
| 3,580,457 | 5/1971 | Henshaw | 72/391 |
| 3,657,915 | 4/1972 | Lee | 72/391 |
| 3,886,783 | 6/1975 | Hirsch | 72/391 |

*Primary Examiner*—C.W. Lanham
*Assistant Examiner*—Gene P. Crosby
*Attorney, Agent, or Firm*—Ernest G. Montague; Karl F. Ross; Herbert Dubno

[57] ABSTRACT

A blind riveter has a pistol-shaped housing connected via hydraulic and pneumatic lines and a rivet-feed duct to an actuator and rivet-feed arrangement. The housing has a tip forming a mandrel-receiving aperture and formed of a plurality of inwardly biased but outwardly deflectable holding elements. A chuck is displaceable in this housing between a front position engageable around the mandrel extending back through the aperture from a blind rivet whose head rests against the tip and a back position spaced well back from this aperture. During displacement from the front to the back position the mandrel is pulled back to upset its rivet and is broken off and during displacement from the back to the front position, the chuck grips the mandrel of a blind rivet that was introduced from behind into the housing behind the aperture and pushes it through the aperture, deflecting the holding elements apart. The rivets are blown into the housing through the feed duct each time the chuck pulls all the way back, and the blast of air feeding the fresh rivet in blows the broken-off mandrel from the previous rivet out the housing. During upsetting of a rivet the holding elements forming the housing tip are locked together and prevented from spreading.

13 Claims, 9 Drawing Figures

FIG. 3c
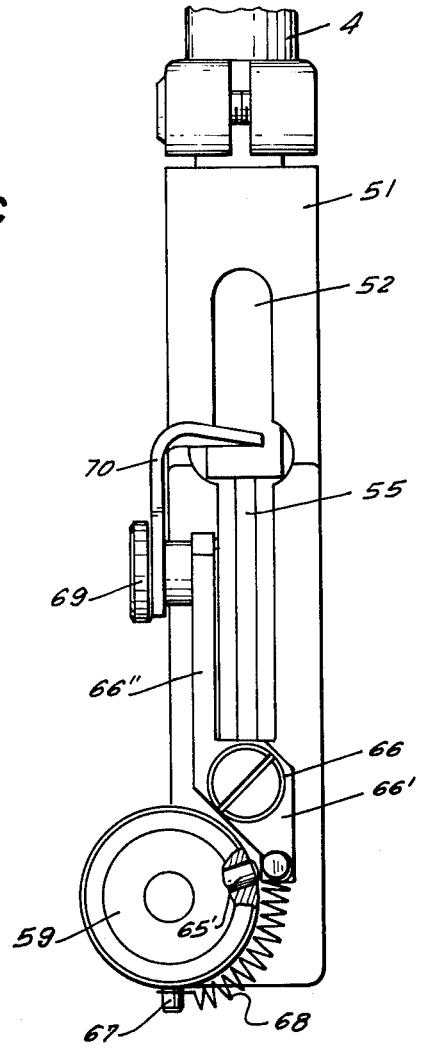
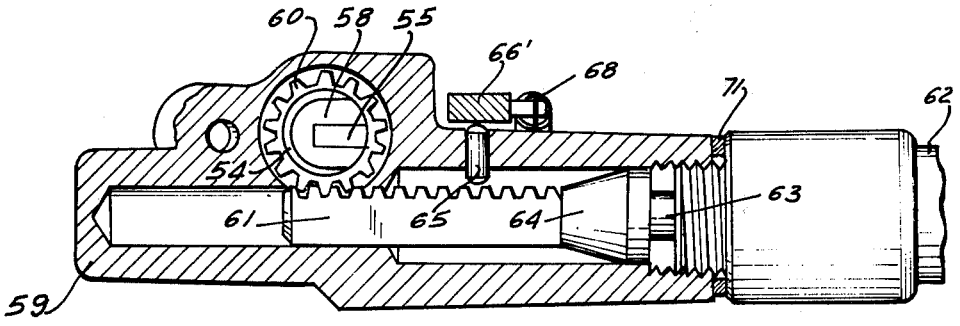
FIG. 3d

BLIND RIVETER WITH AUTOMATIC RIVET FEED

FIELD OF THE INVENTION

The present invention relates to a blind riveter and a method of operating such a riveter. More particularly this invention concerns a riveter that automatically reloads itself with a fresh rivet after each riveting operation.

BACKGROUND OF THE INVENTION

A blind rivet comprises a tubular rivet body in which is mounted a mandrel having a head portion at the narrow stem of the rivet so that when this mandrel is pulled back in the rivet it upsets the rivet. When pulling-back of the mandrel is resisted with a predetermined force the mandrel breaks off. A riveter that operates with such rivets typically has a housing formed at its front end with an aperture through which the rivet mandrel is engaged. Within the housing is a chuck that engages tightly around the mandrel and actuating mechanism is provided to pull this chuck backwardly, thereby upsetting the rivet and breaking off the mandrel. For small-scale operation the operator manually fits a new rivet to the front end of his riveter for each operation.

Devices are also known, as seen for instance in published German application 2,132,286 and in German pat. No. 2,225,058, wherein a feed duct or tube is provided which extends between the riveter and a rivet supply. The nose or tip of the riveter containing the reciprocal chuck must move between a riveting position directed outwardly so that a rivet engaged in the tip of the nose can be inserted in a hole of the workpiece to be riveted, and a loading position in which the tip of the nose fits within the loading device. Thus after each riveting operation this nose must swing from the riveting position into the loading position, and fit exactly against the loading device so as to take up a fresh rivet. Not only is such a mechanism relatively complicated, but a certain amount of production time is lost in each riveting operation while the riveter is reloaded. In addition such a riveter is rather bulky.

Another type of riveter is known, as seen for instance in German patent No. 2,113,664, wherein a tape formed with a row of holes in each of which is engaged a single blind rivet passes transversely through the nose of the riveter. Mechanism is provided on the riveter to take the broken-off mandrel from an earlier riveting operation out of the chuck and insert it through the tape and to pull a fresh rivet out of the tape and insert it in the chuck. In order to be practical such a device must use a relatively long tape so that a bulky and work-obscuring tool is obtained. Furthermore the use of the tape increases the rivet cost and discarding of this tape with a row of mandrels pierced through it again increases production cost. The provision at the nose or head of the apparatus of the various devices for displacing and locking the rivet tape increases the size and complexity of the unit, making it more expensive and less easy to use.

OBJECTS OF THE INVENTION

It is therefore an object of the present invention to provide an improved blind riveter and method of operating same.

Yet another object is the provision of such a riveter with an automatic reloader that is of small size and is, hence, easy to handle.

Yet another object is to provide a blind riveter and method of operating such a riveter which has a very fast cycling time so as to minimize waste of time in production.

SUMMARY OF THE INVENTION

These objects are attained according to the present invention in a blind riveter having a front end or working tip formed with an aperture adapted to snugly engage around the mandrel of a blind riveter whose head rests against the front end of the riveter at the aperture. This front end is constituted by a plurality of outwardly deflectable elements and the chuck within the body of the riveter that grips the mandrel is displaceable back far enough from the aperture to allow a rivet complete with its mandrel to be introduced from behind into the chamber formed at the tip of the riveter behind the aperture. Thus the chuck is pulled back, after upsetting a rivet far enough so that another rivet may be introduced into the space between it and the aperture. The chuck is then advanced so as to grip the mandrel of the newly introduced rivet and push this rivet forward through the end piece of the riveter, laterally deflecting the elements constituting this end piece as it is pushed forward. The elements snap together after the rivet is pushed clear through the end piece and engage snugly around the mandrel of this rivet so that another riveting operation can take place.

Thus in accordance with the present invention the riveter comprises a housing having a front end and formed adjacent this end with a chamber. A plurality of outwardly deflectable holding elements define the forwardly opening aperture dimensioned to fit around the mandrel of the blind rivet. The chuck in the chamber lockingly engageable with the blind rivet mandrel is displaceable therein between a front position lockingly engageable around a mandrel extending back into the chamber through the aperture from a blind rivet having a head resting against the holding elements and a back position spaced from this aperture by a distance greater than the length of a blind rivet with its mandrel. A rivet feed duct opens into the chamber in back of the aperture and forwardly of the chuck in the back position. This duct extends backwardly from the front end and is connected to means for holding a supply of rivets and for separating individual rivets from this supply and feeding one rivet through the duct to the chamber each time the chuck is displaced into the back position. The rivet supply and automatic feeder may therefore be remote from the riveting tool itself so that this tool can be of compact dimensions. Indeed it is possible in such a system, especially when a pneumatic-hydraulic actuator is provided, to provide an extremely slim tool that allows the operator to see exactly what he is doing and give him access to hard-to-reach locations.

In accordance with the present invention, means is provided for locking the holding elements together to prevent their lateral displacement away from each other at least during the front-to-back stroke of the chuck. In this manner accidental pulling of the entire blind rivet back into the chamber during upsetting of the rivet is prevented. This locking mechanism is constituted by a tube surrounding the chuck and displaceable along the same axis as the chuck. The front end of the tube engages within a recess or recesses in the locking elements at least during the backward stroke of the chuck so as to prevent their lateral displacement apart. In accordance with the invention the holding elements are each formed with a groove section and all these groove sections together form a backwardly open annular groove in which the front end of the locking tube is receivable. This tube is formed on one of its sides with an opening or slot that is alignable with the outlet end of the feed duct so as to allow a rivet to be introduced into the chamber. It is also formed with another opening or slot through which a broken-off mandrel may be expelled. The automatic rivet feeder operates pneumatically and the blast of air that feeds a rivet into the chamber may also serve to blow a broken-off mandrel out of the chuck.

According to further features of this invention the closing tube and the chuck are both connected to pistons carried in a common cylinder at the back end of the riveter housing. These pistons are both annular and coaxial with hydraulic pressure effective between the two pistons to withdraw the chuck under high pressure and pneumatic pressure being effective to pull the piston of the holding sleeve back as well as to return the piston of the chuck to its front position. A third piston coaxial with the two annular pistons may be slidable within the chuck piston and connected via a spring to a mandrel-centering rod that insures proper positioning of the blind rivet at the start of each cycle. This third piston is operated by pneumatic pressure also.

According to another feature of this invention the end of the feed duct remote from the riveter opens into a small cylindrical chamber having a laterally opening port and fitted internally with a sleeve having a lateral slot alignable with the port. Means such as an auger or the like feeds rivets one at a time to the chamber through the port and slot. On the side of the chamber opposite the port there is provided a compressed-air inlet. When the sleeve lining the chamber is turned so that its slot aligns with the port the back side of the sleeve blocks the compressed-air inlet and a rivet may be fed into the chamber within the sleeve through the aligned slot at the port. Then the sleeve can be rotated through 180° so as to align with slot with the compressed-air inlet. Compressed air may then rush into the chamber and blow the admitted rivet through the feed duct into the riveter. This operation takes place after the chuck has been withdrawn sufficiently to allow the new rivet to be admitted into the chamber between the aperture and the front end of the chuck. This automatic rivet feeder is operated by a double-acting pneumatic cylinder that rotates the sleeve synchronously with operation of the riveter and feeds rivets one at a time to the input port. Thus this system may operate from a supply of loose rivets, no connecting tape being necessary.

Thus with the riveter according to the present invention actuation of a button or trigger on the hand-held riveter pulls the chuck back in the housing and simultaneously moves the sleeve in the automatic feeder so that a new rivet can be taken into the chamber. As the chuck pulls back it upsets the rivet whose head lies against the front end of the riveter and breaks off the mandrel projecting backwardly from this rivet. The chuck then moves all the way back and the sleeve in the automatic feeder rotates so that a new rivet can be blown through the feed duct into the chamber in back of the aperture in front of the riveter housing, the blast of air conducting this rivet up also serving to blow the broken-off mandrel out through the aligned slots in the top of the riveter housing. Then the chuck starts to move forward and push the newly introduced rivet out between the outwardly deflectable holding elements constituting the top of the riveter these holding elements having been released by the holding tube. The mandrel-aligning rod moves forward so that the new rivet is positioned at the tip of the riveter with its head resting against the front end of the holding elements which are then locked again in place and the mandrel is tightly gripped by the chuck. A new cycle may then be commenced.

The entire cycling time is extremely short, in fact so short that the new rivet virtually appears at the tip of the riveter after each riveting operation so that the only factor determining riveting speed is how quickly the operator can reposition the tool and place the next rivet.

The riveter according to the present invention can use rivets of virtually any diameter and length so long as the largest rivet may pass through the feed duct and fit between the chuck and the aperture in the fully withdrawn position of the chuck. The end piece constituted by the outwardly deflectable holding elements may be switched for different sizes of rivets, an operation that takes very little time. The use of hydraulic pressure to upset the rivet allows even heavy-duty rivets to be employed.

BRIEF DESCRIPTION OF THE DRAWING

The above and other objects, features and advantages of the invention will become more readily apparent from the following description, reference being made to the accompanying drawing in which:

FIG. 3*c* is a view taken in the direction of arrow III*c* of FIG. 3*a;*

FIG. 3*d* is a section taken along line III*d* – III*d* of FIG. 3*a;*

SPECIFIC DESCRIPTION

Figure 1:
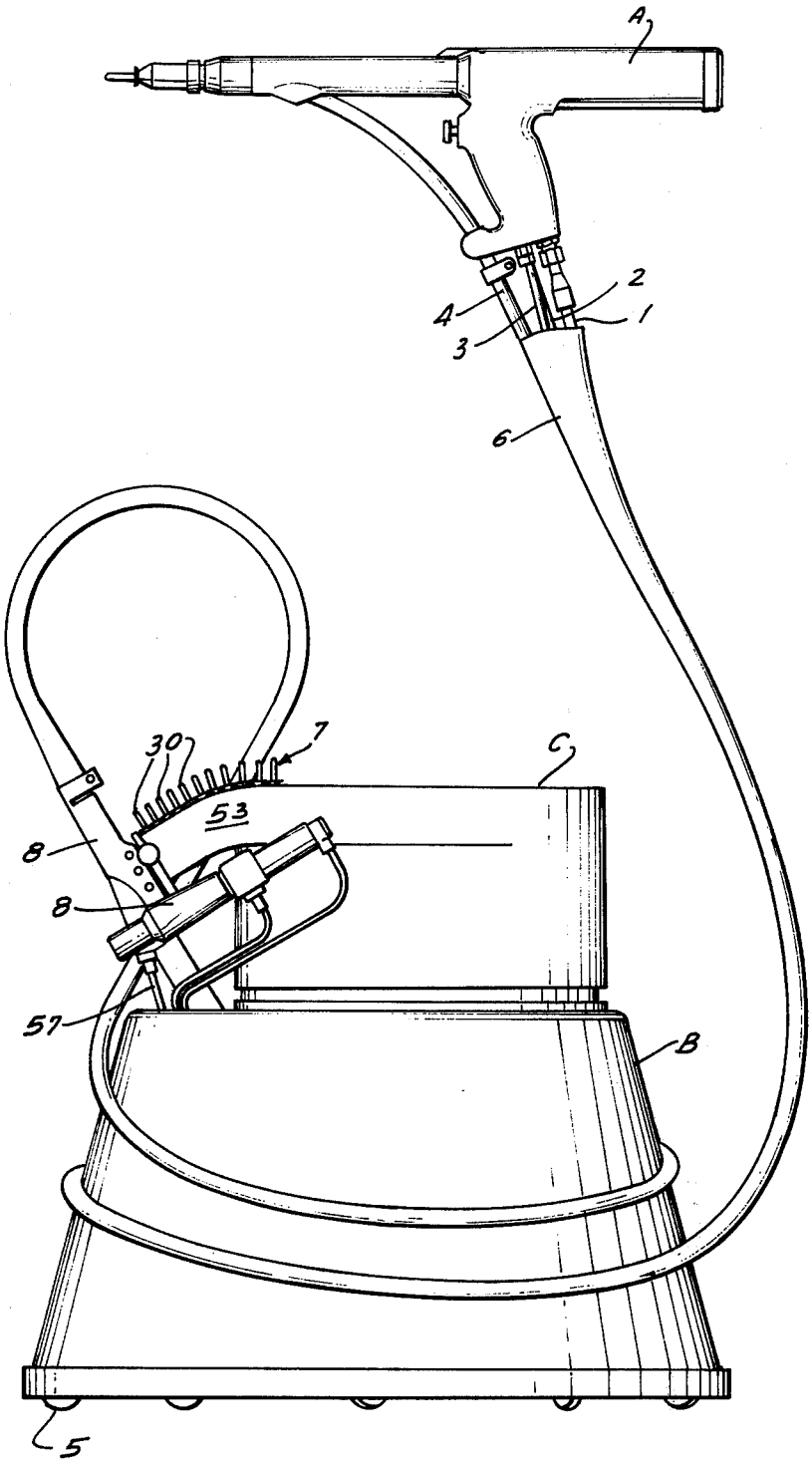
FIG. 1 is a side view showing the riveting apparatus according to the present invention.

As shown in FIG. 1 the riveting apparatus according to this invention basically comprises a pistol-type riveting tool A connected via a hydraulic pressure line 1 and a pneumatic pressure line 2 as well as by a pneumatic control line 3 and a pneumatic feed line 4 all shrouded in a protective sheaf 6 to a rivet feeder C sitting on a base *b* provided with rollers 5. Rivets 30 are separated from a supply 7 by a device 8 on the feeder C and thence fed through the line 4 to the riveting tool A.

Figure 2:
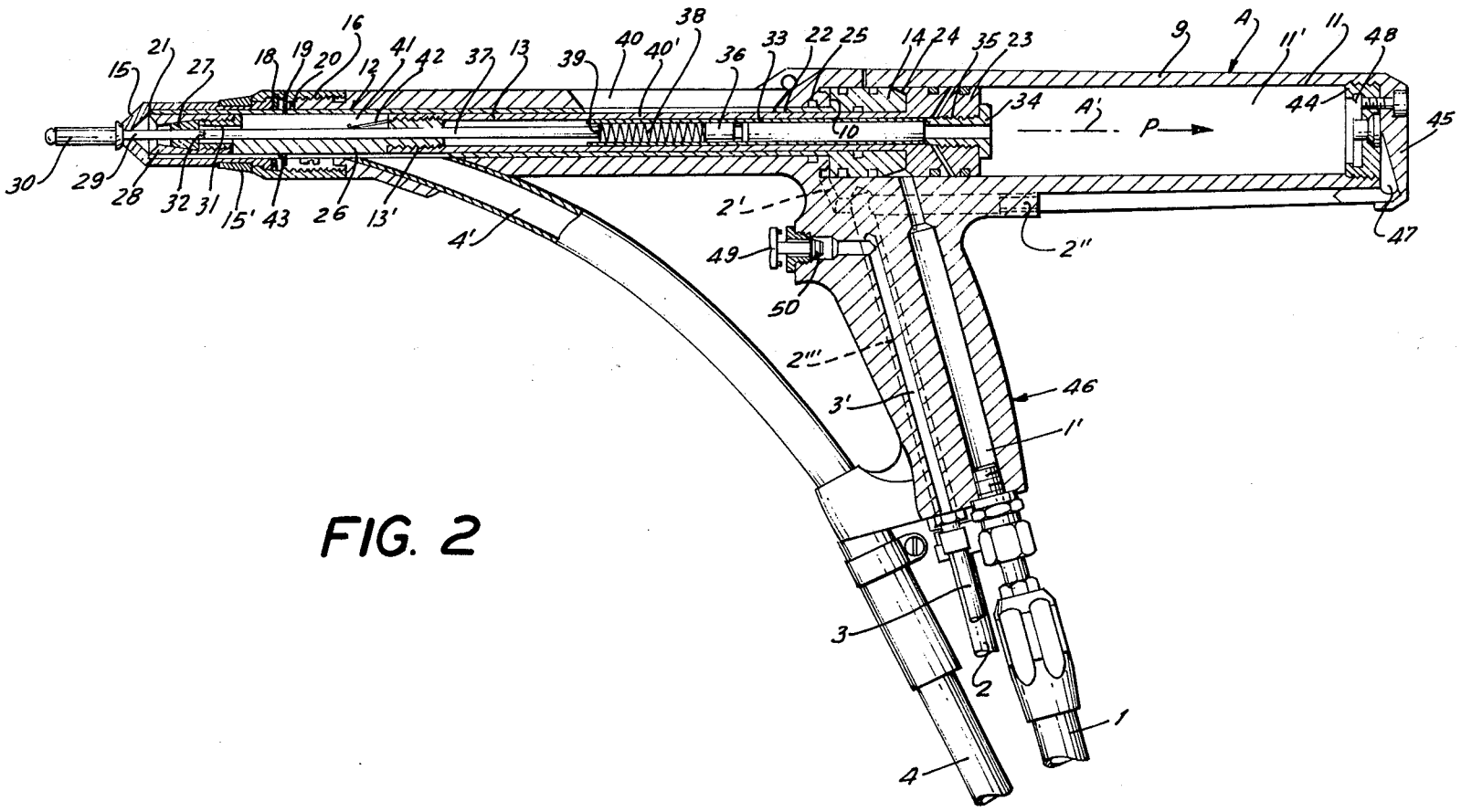
FIG. 2 is a longitudinal section through the riveting tool shown in FIG. 1.
Figure 4:
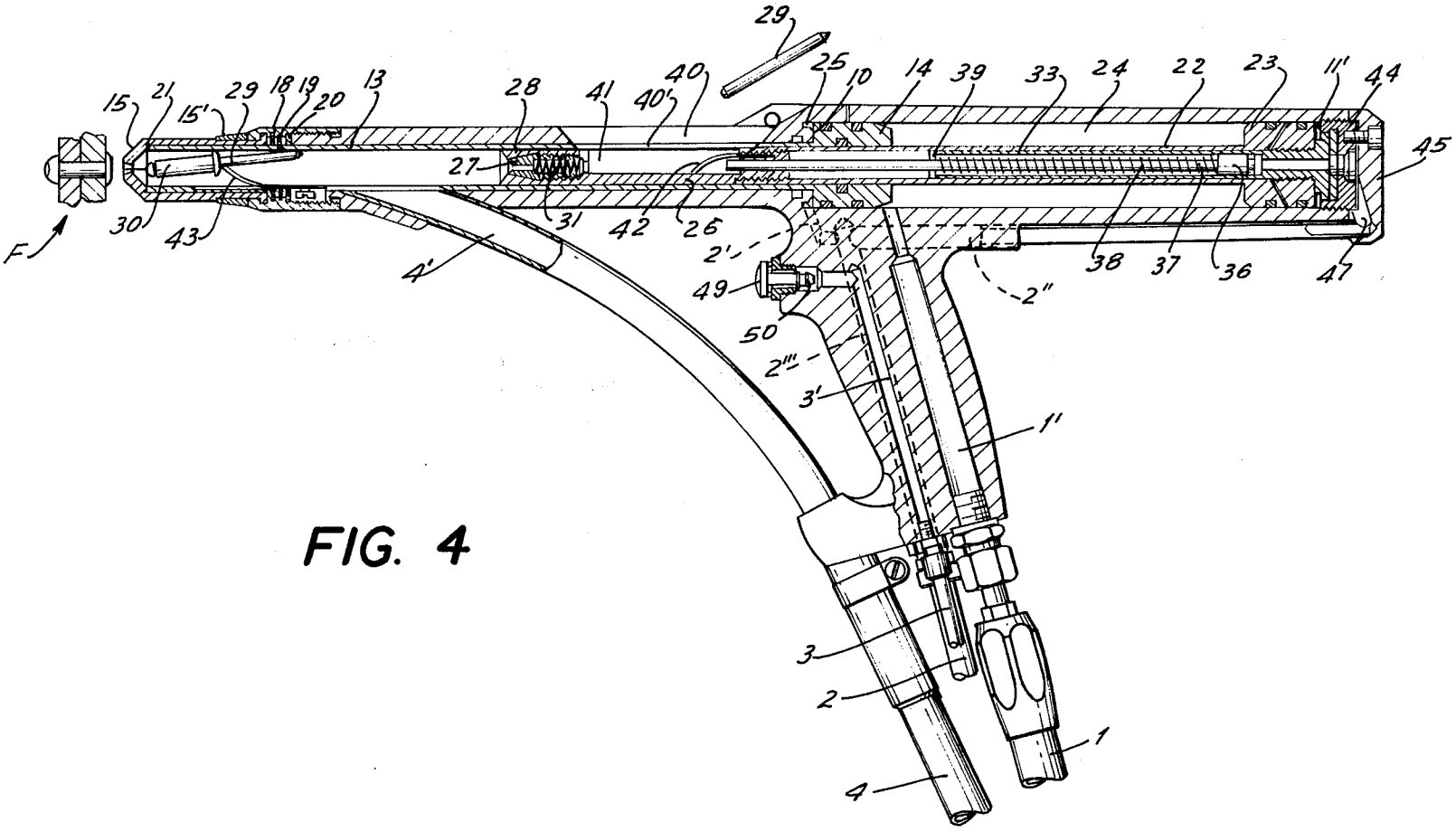
FIGS. 4 and 5 are views similar to FIG. 1 showing the riveting tool in two other positions.
Figure 5:
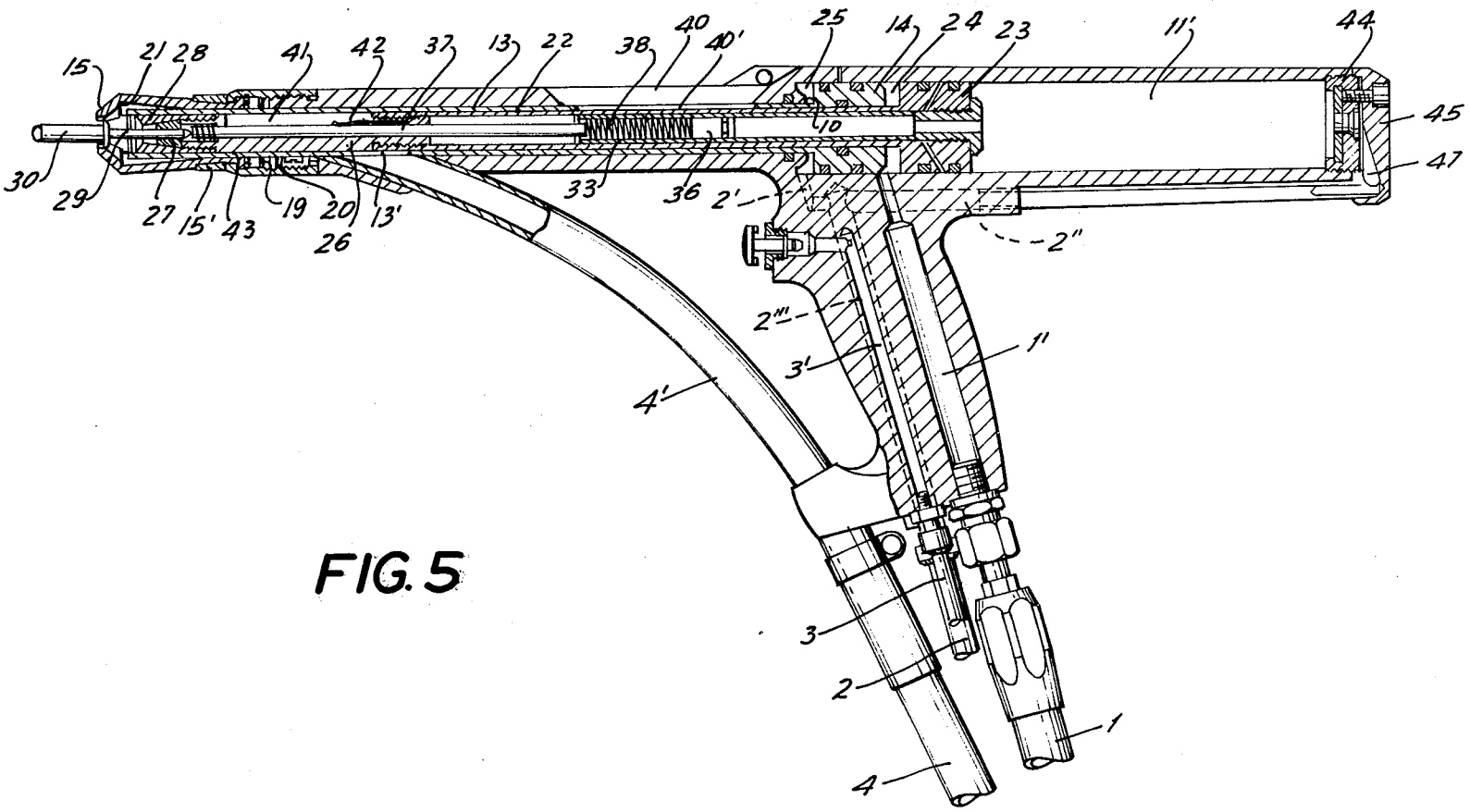

The tool A as shown in FIGS. 2, 4 and 5 has a pistol grip 46 extending at an angle from a housing 9 subdivided by a shoulder 10 into a rear large-diameter cylinder 11 and a front small-diameter cylinder 12 both centered on an axis A′.

The front section 12 is fitted internally with a locking tube 13 unitarily formed at its rear end with an annular piston 14 displaceable axially in the rear section 11 of the housing 9. The front face of the piston 14 normally lies against the shoulder 10 of the housing 9. The front end of the outer locking tube 13 fits between the outwardly deflectable holding elements 15 forming the tip of the front section 12. These elements 15 are normally held together in the position of FIG. 2 by means of a split-ring spring 15′ and are secured to the housing section 10 by means of a threaded connecting nut 16 that allows the entire end piece to be changed when rivet size is changed. The sleeve 16 forms an annular chamber 17 around the locking tube 14. Split-rings 18 and 19 provided in grooves on the sleeve 16 and locking tube 13 normally rest one against the other defining a forward position for the tube 13. The tube 13 may be withdrawn so that its ring 19 rests against a cushion disk 20 provided on the front end of the section 12 and spaced from the ring 18. The front end of the locking tube 13 fits within an annular groove 21 formed in all of the outwardly deflectable elements 15 so that when in the forward position as illustrated in FIGS. 2 and 4 these elements 15 cannot be deflected outwardly relative to the axis A′ of the housing 9.

Coaxially within the tube 13 is a chuck tube 22 terminating at its rear end in an annular piston 23 that normally lies against the back face of the locking piston 14. The pistons 13 and 22 are sealed relative to each other and to the cylinder 12. The rear face of the piston 14 is beveled to form an annular chamber 24 between it and the front face of the piston 23 and the shoulder 10 is undercut to form an annular chamber 25 forwardly of the piston 14. Screwed into the front of the chuck tube 22 is a tubular and axially elongated element 26 carrying at its front end a chuck 28 provided with three jaws 27 adapted to engage around the mandrel 29 of a blind rivet whose head rests against the tip formed by the frustoconically tapered holding elements 15. A sleeve 32 biased forwardly by a spring 31 normally urges the jaws 27 forwardly on the forwardly tapered inner surface of the chuck 28.

The housing section 12 and tube 13 are provided with normally registering axially extending slots 40 and 40′, respectively, which have an axial length greater than that of the broken-off mandrel as will be described below. In addition the element 26 is formed at its top with a longitudinally extending slot 41 in which is provided a leaf spring which normally lies against the bottom surface of the element 26 extending across the axis A′. Another leaf spring 44 secured to the tube 43 as best seen in FIG. 4 is normally flattened out beneath the element 26 but may extend upwardly across the axis A′.

Another tube 33 snugly received in the chuck tube 22 is threaded at its back end into the piston 23 and provided with a head 34. A shoulder 35 inside the tube 33 serves as a rear abutment for a piston 36 which is provided with an axially forwardly extending rod 37 that can project into the chuck 28. A compression spring 38 normally presses the piston 36 back inside the tube 33. This spring 38 bears at its front end against a snap ring 39 fitted within the tube 33.

The rear section 11 defines a chamber 11′ that is sealed at its rear end by a threaded stop 44 serving as a rear abutment for the chuck piston 23 and held in place by a threaded cap 45.

The hydraulic pressure line 1 opens into a passage 1′ in the piston grip 46 which terminates at the chamber between the pistons 14 and 23. Another passage 2‴ formed in the grip 46 connects the compressed-air line 2 to a pair of passages or conduits 2′ and 2″ which terminates respectively at chambers 25 and at a passage 47 opening into a bore 48 in the end stop 44 and thence into the chamber 11′. An actuation button 49 when depressed opens a valve 50 that bleeds pressure out of a passage 3′ connected to the pneumatic control line 3.

A hole or slot 13′ formed in the locking tube 13 in back of the tip of the apparatus is aligned with a rigid but curved tube 4′ of internal diameter sufficient to allow a rivet 30 complete with its mandrel 29 to pass up through the tube 4′ and extending backwardly at an angle to the axis A′ from the front end of the housing 9. This tube 4′ is connected to the flexible rivet feed duct or tube 4.

Figure 3A:
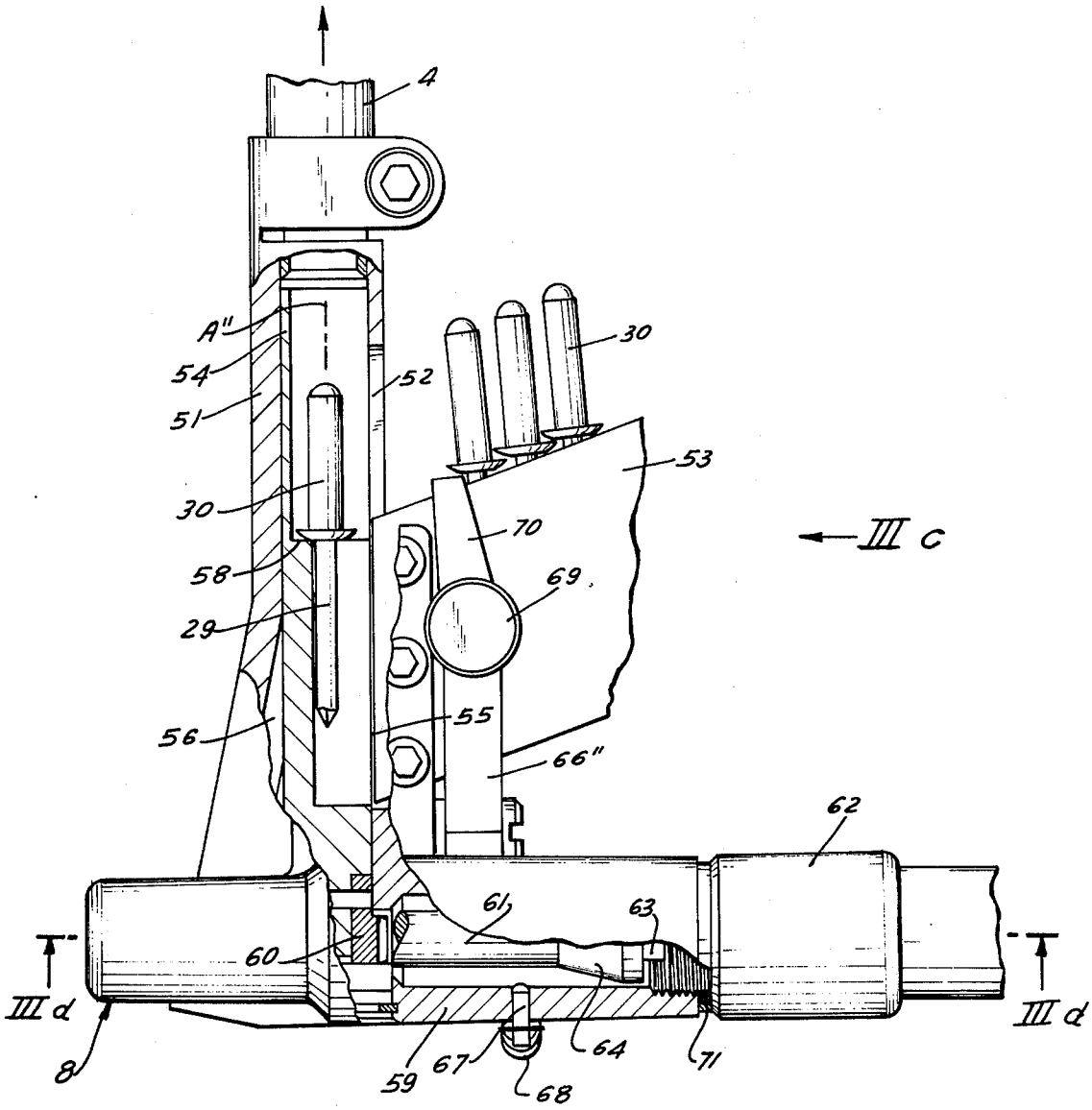
FIGS. 3*a* and 3*b* are sections through a detail of the automatic rivet feeder in accordance with this invention, showing the mechanism thereof in two different positions.
Figure 3B:
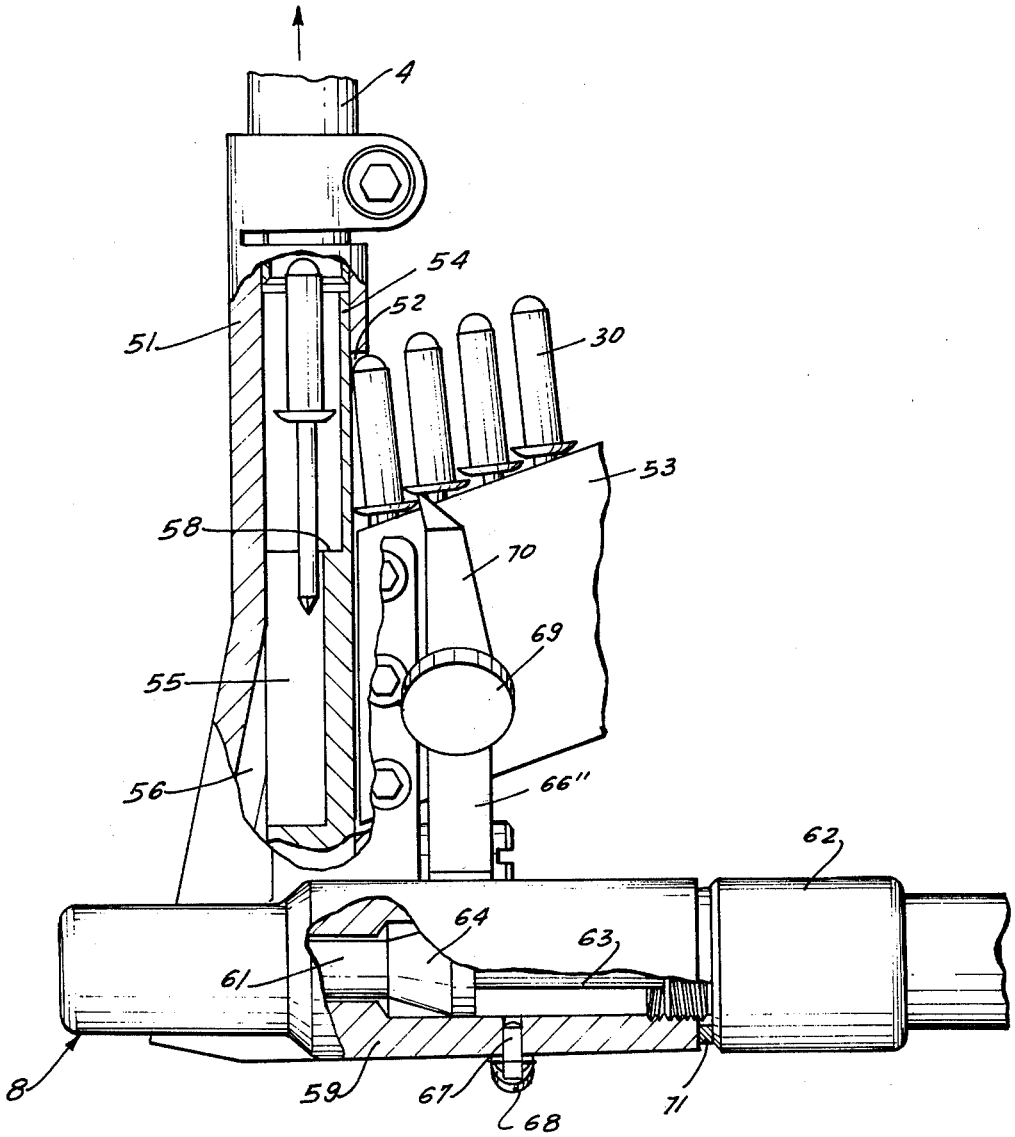

The tube or feed duct 4 terminates in a cylindrical housing 51 shown in FIGS. 3*a* – 3*c* and formed with a vertical slot 52 aligned with the end of an inclined guide 53. The rivets 30 of the supply 7 rest with their mandrels 29 extending downwardly into this guide 53 in which an advance auger may be provided, although customarily simple gravity feed is adequate. The cyliner 51 defines an upright axis A″ and a spoon or hollow cylindrical body 54 is rotatable within the cylinder 51 about the axis A′. This element 54 is formed with a radially open slot 55 that can either be turned toward the guide 53 as shown in FIG. 3*a* so as to receive the mandrel 29 of a rivet 30, or it can be turned as shown in FIG. 3*b* diametrically in the opposite direction so as to open toward a compressed-air inlet passage 56 connected via a line 57 (see FIG. 1) to a compressor in the base B. The top of the slot 55 forms a shoulder or shelf 58 on which can rest the head of a rivet 30. When in the position shown in FIG. 3*b*, the wall of the element 54 closes off the slot 52.

Underneath the cylinder 51 the rivet feeder 8 has another cylindrical housing 59 extending generally at a right angle to the cylinder 51 and containing a rack 61 meshable with a pinion 60 carried on the element 54. Thus longitudinal reciprocation of the rack 61 rotates the spoon element 54 between the positions of FIGS. 3*a* and 3*b*. This rack 61 is fitted at 63 into the end of a double-acting compressed-air cylinder 62 and a frustoconical collar 64 is fitted over the attached end of the rack 61. This collar 64 is engageable with a radially reciprocal pin 65 (see FIG. 3*d*).

The side of the actuating cylinder 59 carries a two-arm lever 66 having as shown in FIG. 3*c* a short arm 66′ operable by the pin 65 and connected via a spring 68 to a pin 67 on the cylinder 59, and a long arm 66″ carrying a detent finger 70 adjustable by means of a finger nut 69. This detent finger 70 projects into the path of rivets 30 in the guide 53 so as to block their displacement down this guide 53 as shown in FIG. 3*a*. Engagement of the frustoconical collar 64 with the pin 65 pushes the arm 66′ against the spring force away from the cylinder 59 and simultaneously pulls the finger 70 away from the guide 53 to allow the leading rivet 30 to slide down into the position of FIG. 3*b*.

Thus the double-acting pneumatic cylinder 62, whose stroke is adjusted by means of a spacer washer 71, can displace the mechanism of the automatic rivet feeder 8 between two positions. With the piston withdrawn as shown in FIGS. 3*a*, 3*c* and 3*d*, the slot 55 of the spoon element 54 is aligned with the guide 53 so that a rivet 30 may slide onto the shelf 58. At the same time the passage 56 is blocked, and the finger 70 projects across the guide 53. The cylinder 62 may then be actuated into the position shown in FIG. 3*b* wherein the spoon element 54 blocks off the slot 52 and the slot 55 is aligned with the passage 56. Air under pressure entering through slot 56 will then blow the rivet up off the shelf 58 and along the feed duct 4. At the same time the frustoconical collar 64 will press the pin 65 radially outwardly and pull the finger 70 away from the guide 53 so that the leading rivet 30 may then slide down into position against the closed side of the spoon element 54.

Figure 6:
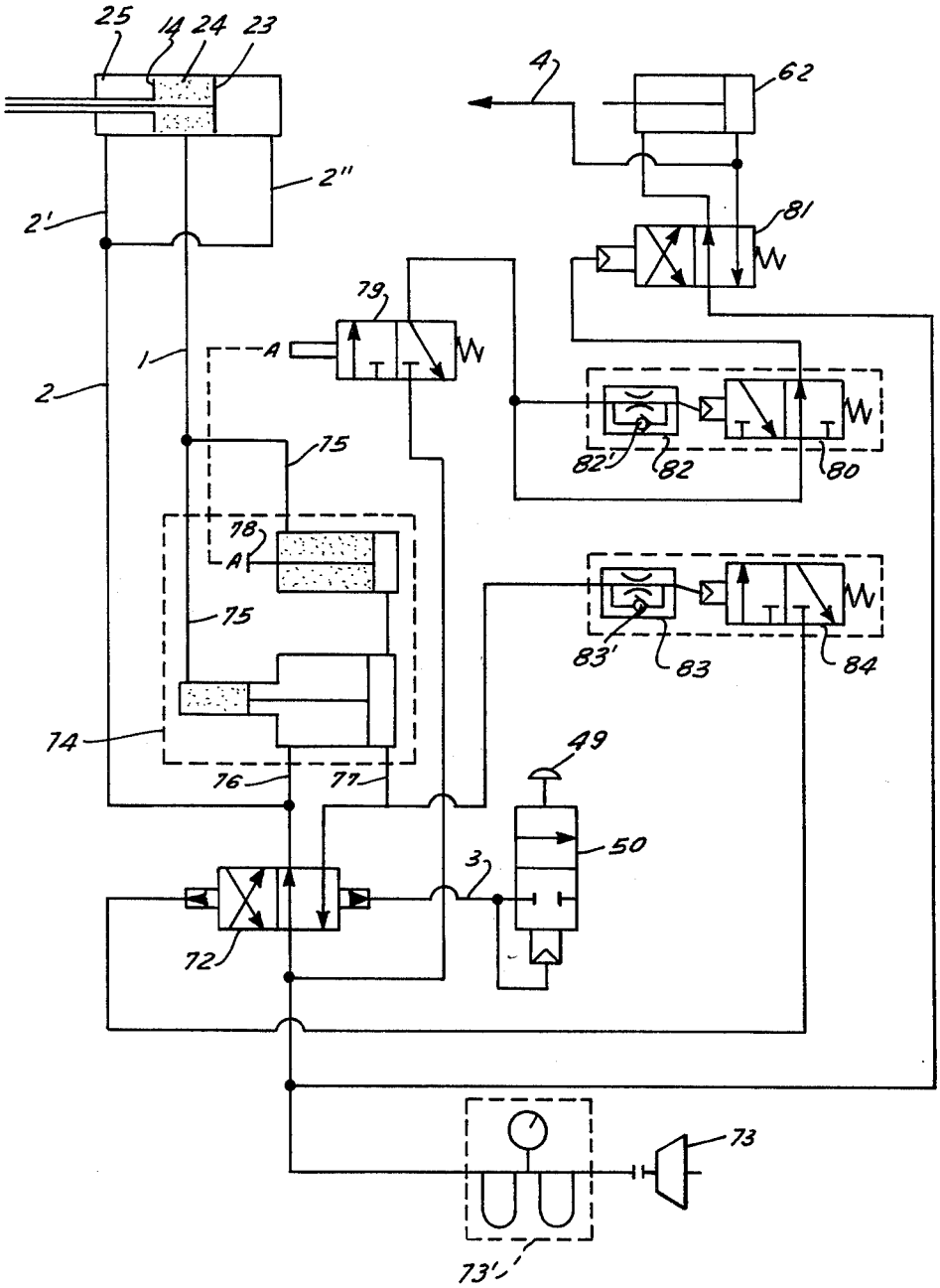
FIG. 6 is a schematic view showing the riveting apparatus and its control system in accordance with the present invention.

As shown in FIG. 6, the chambers 25 and 11' of the riveting tool are connected via the pressure line 2 to a 4/2 reversing valve 72. The other side of this valve is connected to the atmosphere and to a compressor 73 through a filter 73' all housed in the base B. A pneumatic-hydraulic pressure converter 74 has a pair of outlet lines 75 connected to the hydraulic pressure line 1 which opens via the passage 1' into the chamber 24 between pistons 14 and 23. This pressure converter 74 has an air inlet line 76 connected to the line 2 and the one output side of the valve 72 and another air input line 77 connected to the other output side of the valve 72. The piston rod 78 of the one cylinder of the pneumatic-hydraulic converter 74 operates a simple 3/2 valve 79 whose other side is connected to another 3/2 valve 80 operable by pneumatic pressure through a throttle 82 connected to the output side of this valve 79. The output side of the valve 80 is connected to a 4/2 reversing valve 81 and, when pressurized, can actuate this valve 81 which itself is connected to the opposite side of the double-acting cylinder 62 of the rivet feeder 8. In addition the output sides of the valve 72 that is connected to the one input 77 of the converter 74 is connected through a throttle 83 to a 3/2 valve 84 that is connected to the one actuation side of the spool valve 72. The other actuation side of this spool valve 72 is connected through the line 3 to the valve 50 operated by the trigger button 49. Restricters such as shown at 82 and 83 are described on pages 137 and 137 of *Fluid Power* (U.S. Government Printing Office: 1966). Each of these restricters 82 and 83 is of the variable type and is shunted by a small check valve 82' and 83' permitting fluid flow away from the respective valve operated by it. Sliding-spool valves such as shown at 72, 79, 80, 81 and 84 are shown on pages 172, 173, and 180 – 185 of *Fluid Power* also.

The riveting apparatus according to the present invention functions as follows:

The compressor 73 pressurizes the chambers 11' and 25 so as to hold the pistons 23 and 14 in the positions indicated in FIG. 2, that is with the piston 14 lying snugly against the shoulder 10 and the piston 23 laying snugly against the back of the piston 14. Since the back face of piston 23 is substantially greater in area than the front face of piston 14 the pressure in the chamber 11' will overcome pressure effective in the opposite direction P on the face of the piston 14. In addition air pressure in the chamber 11' will pass down through the sleeve 33 and push the piston 36 therein forwardly to compress the compression spring 38 and press the rod 37 against the rear tip of the mandrel 29 of a top rivet 30 whose head rests against the tip of holding elements 15. With the piston 14 moved fully to the front position the front end of the tube 13 engages in the groove 21 and prevents spreading apart of the elements 15. The various valves and hydraulic and pneumatic elements of the system are then in the positions indicated in FIG. 6.

Depression of the button 49 opens the valve 50 and switches over the reversing valve 72 by bleeding off the air to one side of its spool. This connects the line 2 and hence the chambers 11' and 25 to the atmosphere and pressurizes the input 77 of the hydraulic-pneumatic converter 74. The line 1 therefore is filled with considerable hydraulic pressure which is effective in the chamber 24 between the pistons 14 and 23 to force the piston 23 back away from the piston 14 until it comes to rest against the stop 44 as illustrated in FIG. 4. This operation pulls the mandrel 29 back in the rivet 30 previously fitted between a pair of plates as shown at F, upsetting this rivet. The rod 78 from the converter 74 switches the valve 79 so as to apply pressure through the valve 80 to the reversing valve 81 operating the double-acting pneumatic cylinder 62 of the rivet feeder. This action switches the spoon from the position of FIG. 3*a* to the position of FIG. 3*b* wherein a rivet may be blown up in the line 4 into the riveting tool, sliding over and catching in front of the bent-up spring 43 as illustrated in FIG. 4. The blast of air that conducts this rivet 30 into the riveting tool also serves to blow the mandrel 29 out of the chuck 28 and out through the aligned slots 40 and 40' of the riveting tool. A bag may be provided to catch these mandrels as they are expelled. The spring 42 snaps down against the element 26 and over the end of the retracted rod 37 so that as the mandrel 29 is blown backwardly it is deflected up and out of the housing.

After a brief interval enough pressure will leak through the restricter 82 to slide the valve 80 over against its spring and therefore cause the spring of the valve 81 to move it back into its original position so that the spoon 54 can return to the position of FIG. 3*a* and accept another rivet.

Simultaneous with the pressurization of the input 77 of the converter 74 pressure is applied via the restricter 83 to a valve 84 connected to the chamber at the opposite side of the spool of the valve 72 as the valve 50. After a very brief interval pressure builds up to switch the valve 84 to return the valve 72 to the position illustrated in FIG. 6, applying pressure to the chambers 11' and 25.

Pressurization of these chambers 11' and 25 pushes the withdrawn piston 23 forwardly and temporarily drives the front piston 14 back as shown in FIG. 5. Backward displacement of this front piston 14 causes the front end of the tube 33 to disengage from the groove 21 allowing outward lateral deflection of the elements 15. Similarly pressurization of the chamber 11' forces the piston 14 forward and forces the piston 36 within the sleeve 41 forwardly also. The rivet previously fed into the chamber within the front end of the riveting tool is caught by the frustoconical tip of the chuck 28 and its mandrel is engaged between the jaws 27. The pin 37 presses against the back end of the mandrel and, as the piston 23 and the rod 37 advance, the blind rivet is pushed outwardly between the elements 15, deflecting them apart as shown in FIG. 5. Once the piston 23 moves all the way forward against the piston 14 the rivet 30 lies outside the housing so that the element 15 can snap back together. Since the back face of the piston 23 is larger than the front face of piston 14, continued equal pressurization of these chambers 11' and 25 causes the piston 23 to press the piston 14 forwardly and lock these elements 15 together with the tube 13.

The riveter has therefore returned to the position of FIG. 2 and another rivet can be set.

Thus with the apparatus according to the present invention simple actuation of the button causes the rivet at the tip of the tool to be upset and almost immediately feeds a new rivet to the tool ready for emplacement. The rivets need not be of any particular size and can be loaded separately and loosely into the guide 53 on the feeder C. Since the rivet supply 7 is easily visible to the operator of the riveting tool A he may readily determine if he has enough of a supply for the job, and can even change rivet sizes at any time should he care to do so. A plurality of such riveting tools A can be connected to a common feed arrangement if desired. Furthermore the actuation button 49 can be dispensed with and a foot pedal or the like be provided.

I claim:

1. A blind riveter comprising:

a housing having a front end and formed adjacent said end with a chamber;

a plurality of outwardly deflectable holding elements at said front end normally defining a forwardly opening aperture dimensioned to fit around the mandrel of a blind rivet;

a chuck in said chamber locking engageable with a blind-rivet mandrel;

actuating means in said housing connected to said chuck for displacing same between a front position lockingly engaged around a mandrel extending back into said chamber through said aperture from a blind rivet having a head resting against said holding elements and a back position spaced from said aperture by a distance greater than the length of a blind rivet with its mandrel, whereby displacement from said front to said back position with said chuck gripping a mandrel pulls the mandrel back in its rivet and upsets the rivet;

a rivet feed duct opening into said chamber in back of said aperture and forwardly of said chuck in said back position, said duct extending backwardly from said front end;

means for holding a supply of blind rivets and for separating individual rivets from said supply and feeding one rivet through said duct to said chamber each time said chuck is displaced into said back position, whereby displacement of said chuck from said back to said front position after introduction of a rivet into said chamber engages said chuck around the rivet mandrel and pushes the rivet through said aperture by outwardly deflecting said elements and pneumatic means for operating said actuating means and said means for feeding and triggerable for each operation cycle to displace said chuck to upset a rivet, dislodge a broken-off mandrel therefrom and position a new rivet in said chuck automatically for a single stroke of said actuating means.

2. The riveter defined in claim 1, further comprising means for locking said elements together and preventing lateral deflection apart of said members at least during displacement of said chuck from said front to said back position.

3. The riveter defined in claim 1 wherein said means for holding and separating includes a guide supporting a row of such blind rivets, a rivet chamber connected to said feed duct and having a laterally openable port alignable with said guide, and means for separating one rivet from said guide, feeding same through said port into said rivet chamber, and blowing same with gas pressure through said duct into said chamber of said housing.

4. A blind riveter comprising:

a housing having a front end and formed adjacent said end with a chamber;

a plurality of outwardly deflectable holding elements at said front end normally defining a forwardly opening aperture dimensioned to fit around the mandrel of a blind rivet;

a chuck in said chamber locking engageable with a blind-rivet mandrel;

actuating means in said housing connected to said chuck for displacing same between a front position lockingly engaged around a mandrel extending back into said chamber through said aperture from a blind rivet having a head resting against said holding elements and a back position spaced from said aperture by a distance greater than the length of a blind rivet with its mandrel, whereby displacement from said front to said back position with said chuck gripping a mandrel pulls the mandrel back in its rivet and upsets the rivet;

a rivet feed duct opening into said chamber in back of said aperture and forwardly of said chuck in said back position, said duct extending backwardly from said front end;

means for holding a supply of blind rivets and for separating individual rivets from said supply and feeding one rivet through said duct to said chamber each time said chuck is displaced into said back position, whereby displacement of said chuck from said back to said front position after introduction of a rivet into said chamber engages said chuck around the rivet mandrel and pushes the rivet through said aperture by outwardly deflecting said elements; and, means for locking said elements together and preventing lateral deflection apart of said members at least during displacement of said chuck from said front to said back position, said means for locking including backwardly directed formations on said elements and a locking member reciprocal in said housing between an advanced position interfitting with said formations on said elements and preventing outward displacement thereof and a withdrawn position out of engagement with said formations.

5. The riveter defined in claim 4 wherein said formations are backwardly directed groove sections together forming a backwardly open annular groove and said member is a tube having a front end receivable in said groove.

6. The riveter defined in claim 4 wherein said actuating means includes a cylinder in said housing and a rear chuck piston connected to said chuck and reciprocal in said housing, said means for locking including a front locking piston in said cylinder in front of said rear chuck piston.

7. The riveter defined in claim 6 wherein said front piston defines a front compartment in said cylinder and has a predetermined effective piston area, said rear piston defining a rear compartment in said cylinder and having a predetermined effective piston area greater than that of said front piston, said actuating means including means for feeding a gas under a predetermined pressure to both of said compartments and for feeding a hydraulic fluid under pressure to the space between said front and rear pistons.

8. The riveter defined in claim 7 wherein said rear piston is formed as a tube and is provided with an inner piston carrying a rod engageable from behind with a mandrel engaged in said chuck, said tube being open into the rear compartment for pneumatic actuation of said inner piston, said inner piston being provided with a spring normally biasing said inner piston backwardly.

9. The riveter defined in claim 7 wherein said front piston is provided with a forwardly extending tube surrounding said chuck and constituting said locking members, said tube being formed with a laterally opening slot between said front piston and said chuck in said back position, said housing being formed with a throughgoing slot alignable with said slot of said tube for ejection of a broken-off rivet mandrel.

10. A blind riveter comprising:

a housing having a front end and formed adjacent said end with a chamber;

a plurality of outwardly deflectable holding elements at said front end normally defining a forwardly opening aperture dimensioned to fit around the mandrel of a blind rivet;

a chuck in said chamber lockingly engageable with a blind-rivet mandrel;

actuating means in said housing connected to said chuck for displacing same between a front position lockingly engaged around a mandrel extending back into said chamber through said aperture from a blind rivet having a head resting against said holding elements and a back position spaced from said aperture by a distance greater than the length of a blind rivet with its mandrel, whereby displacement from said front to said back position with said chuck gripping a mandrel pulls the mandrel back in its rivet and upsets the rivet;

a rivet feed duct opening into said chamber in back of said aperture and forwardly of said chuck in said back position, said duct extending backwardly from said front end; and means for holding a supply of blind rivets and for separating individual rivets from said supply and feeding one rivet through said duct to said chamber each time said chuck is displaced into said back position, whereby displacement of said chuck from said back to said front position after introduction of a rivet into said chamber engages said chuck around the rivet mandrel and pushes the rivet through said aperture by outwardly deflecting said elements;

said means for holding and separating includes a guide supporting a row of such blind rivets, a rivet chamber connected to said feed duct and having a laterally openable port alignable with said guide, and means for separating one rivet from said guide, feeding same through said port into said rivet chamber, and blowing same with gas pressure through said duct into said chamber of said housing, said rivet chamber being generally cylindrically elongated and has one end connected to said feed duct and a compressed-gas inlet opening into said rivet chamber and directed generally at said one end, and a rivet holding element in said cylinder displaceable between one position uncovering said port and blocking said inlet to admit a rivet into said rivet chamber, and another position covering said port and unblocking said inlet.

11. The riveter defined in claim 10, wherein said guide is an upwardly open channel extending generally upwardly away from said port and dimensioned to receive mandrels of a row of blind rivets.

12. A method of operating a blind riveter having a housing formed at its front end with an aperture and formed therebeyond with a chamber in which is reciprocal a chuck engageable around a blind-rivet mandrel, said method comprising the steps of sequentially:

gripping with said chuck a mandrel extending back into said chamber through said aperture from a blind rivet whose head rests against said front end at said aperture, displacing said chuck backwardly in said chamber to pull the gripped mandrel back in its rivet and upset same, displacing said chuck further back in said chamber continuously from said upset to leave therein a space between said chuck and said aperture sufficiently long to receive a fresh rivet with its mandrel, introducing a blind rivet with its mandrel into said chamber between said aperture and said chuck, and displacing said chuck forwardly in said chamber to engage around the mandrel therein and laterally deflect the sides of said aperture by pushing the rivet engaged by said chuck forwardly through said aperture, each rivet being separated from a supply of such rivets and being fed from behind into said chamber with its mandrel trailing.

13. The method defined in claim 12, further comprising the step of locking said sides of said aperture together to prevent lateral deflection thereof during the initial displacement of said chuck backwardly in said chamber.

* * * * *